United States Patent [19]

Kiernan, Jr. et al.

[11] Patent Number: 4,917,181

[45] Date of Patent: Apr. 17, 1990

[54] SEGMENTED ANNULAR RECUPERATOR AND METHOD

[75] Inventors: John D. Kiernan, Jr., Beacon Falls; Frederick Sembler, Woodbridge, both of Conn.

[73] Assignee: Textron Lycoming, Stratford, Conn.

[21] Appl. No.: 228,340

[22] Filed: Aug. 4, 1988

[51] Int. Cl.[4] ..... F28F 3/00

[52] U.S. Cl. ..... 165/166; 165/81

[58] Field of Search ..... 165/81, 166, 167

[56] References Cited

U.S. PATENT DOCUMENTS

| | | | |
|---|---|---|---|
| 3,424,240 | 1/1969 | Stein et al. | 165/166 |
| 3,831,674 | 8/1974 | Stein et al. | 165/166 |
| 4,431,050 | 2/1984 | Martin | 165/166 |
| 4,470,454 | 9/1984 | Laughlin et al. | 165/166 |

FOREIGN PATENT DOCUMENTS

| | | | |
|---|---|---|---|
| 399995 | 10/1933 | United Kingdom | 165/81 |

*Primary Examiner*—Martin P. Schwadron
*Assistant Examiner*—Allen J. Flanigan
*Attorney, Agent, or Firm*—Perman & Green

[57] ABSTRACT

A plate-type annular heat exchange cylinder which has increased resistance to cracking under the stress of heat gradients. The invention comprises providing the cylinder in the form of two or more longitudinal segments, such as hemi-cylinders, spaced by axial narrow expansion slots, sealing the spaces between adjacent pairs of the plates of each segment and each expansion slot, uniting the segments by attaching radial coupling plates over the slots at each end of the segments, and blocking the inner peripheral entrance of each axial slot by attaching a narrow gas seal strip thereover.

5 Claims, 4 Drawing Sheets

SEGMENTED ANNULAR RECUPERATOR AND METHOD

BACKGROUND OF THE INVENTION

The present invention relates to heat exchangers and more particularly to improvements in plate type heat exchangers.

Many different types of heat exchangers are known for transferring heat to or from a fluid, usually transferring heat between two fluid media.

In almost all heat exchangers, the rate of heat transfer is of prime concern. This factor is of particular importance where heat exchangers are used in regenerative type gas turbine engines. Briefly, in such engines, waste energy of the hot gas stream exhaust is transferred, through a heat exchanger, to a pressurized air stream as it passes from the engine's compressor to its combustor. Thus the energy level of the hot gas stream generated in the combustor is proportionately increased to give an overall, theoretical, increase in engine cycle efficiency.

Heat exchangers for regenerative type engines, not only require a high rate of heat transfer, but also require a minimum impedance or pressure loss to the flow of the pressurized air and the hot gas streams therethrough. Otherwise, excessive pressure drops in either or both of the fluid flow paths could cause losses which more than offset the theoretical gains to be derived from the regenerative cycle. A factor of concern in such heat exchangers, is the wide range of temperatures encountered in cyclic operation and the resultant stresses that are induced in the component parts of the heat exchanger. The present invention is concerned with avoiding or distributing the stresses normally encountered when an annular plate-type heat exchanger is subjected to gradient heating, which stresses otherwise can result in the cracking of the plates and excessive pressure drops in either or both of the fluid flow paths.

Plate type heat exchangers, while having other applications, have been found particularly effective in fulfilling the needs described above for regenerative type gas turbine engines. A particularly effective heat exchanger of the is disclosed in U.S. Pat. No. 3,424,240. In that heat exchanger, a stack of corrugated plates, in the form of annular discs, define a central entrance for the hot gas discharge of the turbine engine. From this central entrance, the hot gasses pass radially outwardly between alternate pairs of plates to a discharge duct. Pressurized air from the engine compressor flows axially into inlet plenums extending longitudinally of the stack of plates, and then radially through cross flow paths between the plates, to axial exit plenums, also extending longitudinally of the stack of plates, back to the combustor of the engine. Reference is also made to improvement U.S. Pat. Nos. 3,785,435 and 3,831,674 relating to plate-type heat exchangers or recuperators of the general type which can be manufactured in modified form and assembled in accordance with the present invention to incorporate the improvements made possible by the present invention. Broadly, the present heat exchangers include companion pairs of relatively thin plates defining on their opposite sides, opposed portions of flow paths for first and second fluids. These plates are characterized by having first and second series of corrugations with one series being cross corrugations generally at right angles to the other.

The heat exchangers of the present invention and of the aforementioned Patents include pairs of plates peripherally welded to each other to form heat-exchange compartments therewithin, the plate pairs being welded to adjacent plate pairs at intermediate port or plenum areas to define the opposite bounds of the two fluid flow paths within the heat exchange compartments. One plate of each pair has a series of corrugations which are of the same spacing as and aligned with one of the series of corrugations of the other plate place. Further, the corrugations of the one plates are "out of phase" with corrugations of the other plate to define flow paths having longitudinal and cross sections which vary in area. Further, it is advantageous that one of the series of corrugations of the one plate have a lesser height than the other series of cross corrugations thereof and that the corrugations of the other plates are generally aligned with the lower series of corrugations of the one plate, as disclosed in U.S. Pat. No. 3,831,674 for example.

The pairs of first and second plates are formed as annular discs and are arranged in stacked relationship to define therebetween alternate flow paths for the first and second liquids. The intermediate ports or plenums are formed as longitudinal inlet and exit plenums which connect the heat-exchange compartments of the plate pairs for the introduction and discharge of the first liquid. As specifically adapted for use with a regenerative type gas turbine engine, the inlet plenum receives pressurized compressor air and the exit plenum discharges air to the combustor of the engine after the air passes through cross flow, heat exchange flow paths within the heat-exchange compartments of the pairs of plates. The second fluid is the hot gas discharge of the engine which passes through flow paths radial of the stacked discs, between the plate pairs and external to the heat exchange compartments.

The first and second plates, forming each plate pair, have flanges peripherally of their inner and outer diameters. The flanges of each first plate project in one axial direction and the flanges of each second plate project in the opposite direction towards and in matching relationship with flanges of the adjacent first plate. These matching flanges are respectively joined to form a heat exchange compartment to complete the cross flow paths for the pressurized air. Further, the longitudinal plenums are defined by intermediate flanged openings in the first and second plates. The surfaces of the adjacent first and second plates of plate pairs have flanged openings which are welded or joined peripherally of such openings so that the stack of plates becomes a bellows comprising a plurality of heat exchange compartments open to each other via the plenums for the compressed inlet air and the combustor exit air.

SUMMARY OF THE INVENTION

The present invention is concerned with improving the heat resistance of annular plate-type heat exchangers or recuperators of the types defined by the aforementioned Patents, more particularly, with altering the design and assembly of such recuperators to render them more resistant to stress cracking and to resultant pressure drops which reduce or destroy their efficiency.

The present design changes involve manufacturing or converting the stacked disc heat exchanger to the form of sealed cylinder segments, rather than unitary one-piece cylinders comprising united plate pairs, as disclosed in the aforementioned Patents, and assembling the segments as a cylindrical assembly in a manner which prevents the pressurized inlet air and the heated outlet air to the combustor from leaking into the axial gaps between segments, and also blocks the path of the central discharge gas from said axial gaps for maximum efficiency.

More specifically the present invention involves the use of novel pairs of annular plates to form the heat exchange compartments of the recuperator, each of the plates having two or more similar spaced radial portions comprising flanges which, similarly to the inner and outer peripheral flanges, project towards each other to provide flat mating surfaces which can be cut in the radial direction and then welded to each other. This permits the pairs of annular plates to be peripherally welded to each other to form the recuperator comprising heat exchange compartment units, which units are welded to each other at the flanges surrounding the compressed air plenum and the combustor air plenum to form the cylindrical assembly comprising a plurality of the heat exchange plates similar in appearance to the assembly disclosed in U.S. Pat. No. 3,831,674.

However the provision of the plates with mating flat radial portions enables the cylindrical recuperator assembly to be cut radially into two or more axial segments by cutting through the flat mating radial flange surfaces, which extend from the inner periphery, through the inner weld, to the outer periphery, through the outer weld, and then radially welding the cut mating surfaces of the plate pair of each heat exchange unit to each other to seal the individual heat exchange compartments of the segments and form functional segments, each having its own heat exchange compartment, which can be assembled in the manner hereinafter disclosed to provide a stress-resistant recuperator.

THE DRAWINGS

DESCRIPTION OF THE PREFERRED EMBODIMENTS

Figure 1:
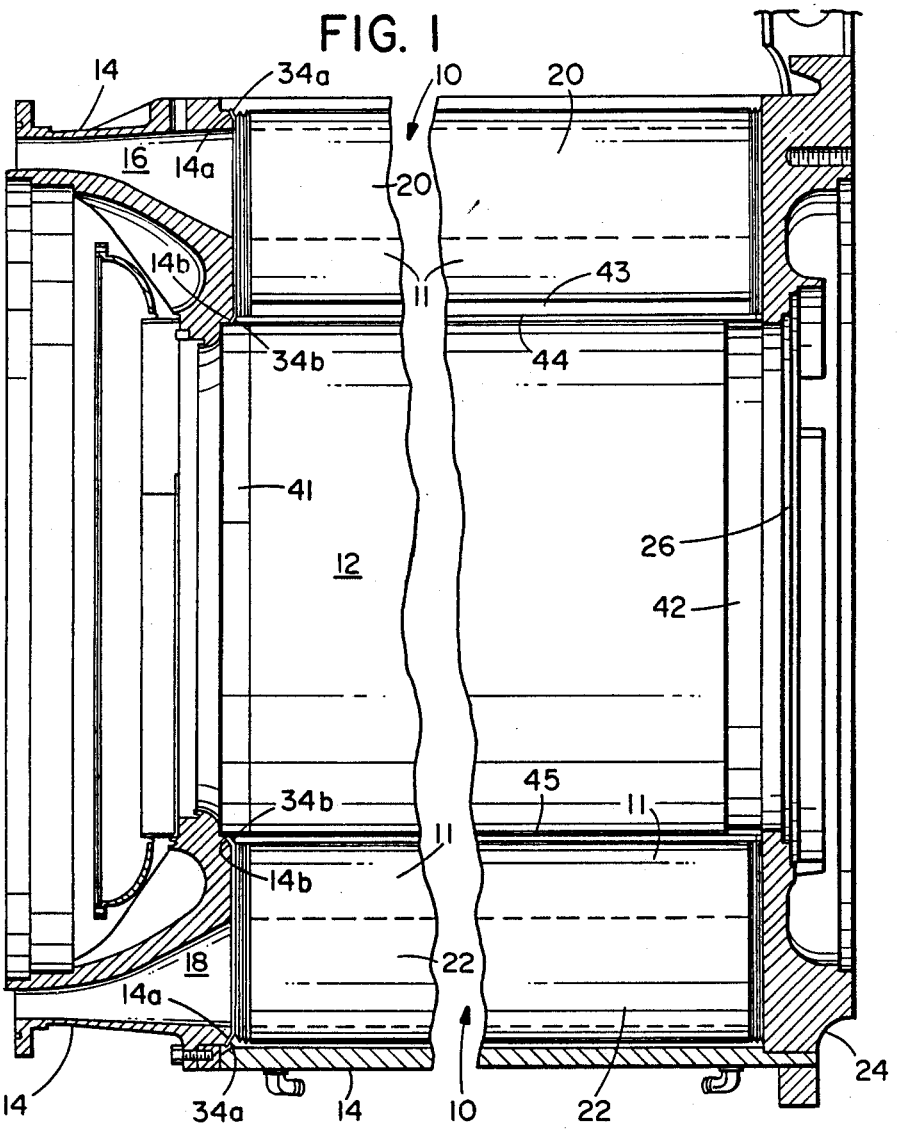
FIG. 1 is a non-diametric longitudinal cross-section of a heat exchanger housing assembly according to the present invention taken through an inlet plenum and a nearly diametrically-opposed exit plenum, a substantial portion of the segmented recuperator unit being cut away to simplify the illustration.
Figure 2:
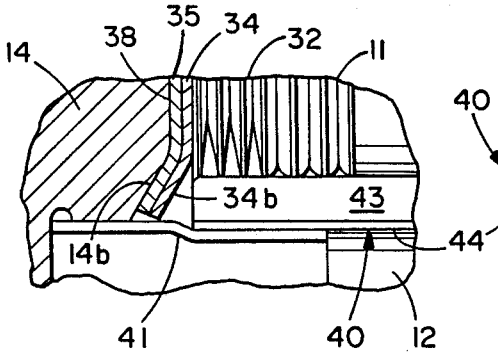
FIG. 2 is an exploded view of a segment of FIG. 1 illustrating the forward interior peripheral seal between the plate unit and the housing, and also illustrating the forward end of the upper longitudinal gas seal insert strip supported at the front or inlet end of the assembly by an inner peripheral forward band, as a forward upper inner gas seal between recuperator and the housing.

The heat exchanger, illustrated in FIG. 1 is adapted for attachment to a gas turbine engine at a point downstream of the final turbine stage of that engine. The engine, itself, may be of conventional construction in accordance with well known designs for regenerative type engines. The hot gas discharge of the engine enters the center compartment 12 of the heat exchanger and then is directed radially outwardly, through a bellows unit 10 comprising a stack of plates 11, to an exhaust system which includes a surrounding duct. The heat exchanger comprises an adaptor frame or housing 14, which may be attached to a frame member of the engine. The adaptor frame 14 has a plurality of passageways 16 and 18 which respectively connect with engine passageways (not shown) leading from the engine's compressor and leading to the engine's combustor. The compressor passageways 16 are aligned with a plurality of inlet plenums 20, see also FIG. 5, formed longitudinally through the bellows unit 10 or stack of plates 11. The combustor passageways 18 are aligned with a plurality of exit plenums 22 also extending longitudinally through the stack of plates 11. Cross flow paths between adjacent plenums 20 and 22 within the heat exchange compartments of each plate pair provide the primary heat exchange between the radially flowing internal hot gas discharge and the pressurized compressor air. These cross flow and radial flow paths are described in detail in U.S. Pat. No. 3,831,674. The heat exchanger further comprises an end frame portion 24 having a central opening 26 which receives a gearbox to form the downstream limit of the hot gas discharge flow paths so that all of the hot gasses may be turned radially outwardly between plate pairs through the stack of plates 11 and discharged through the exhaust system.

Figure 5:
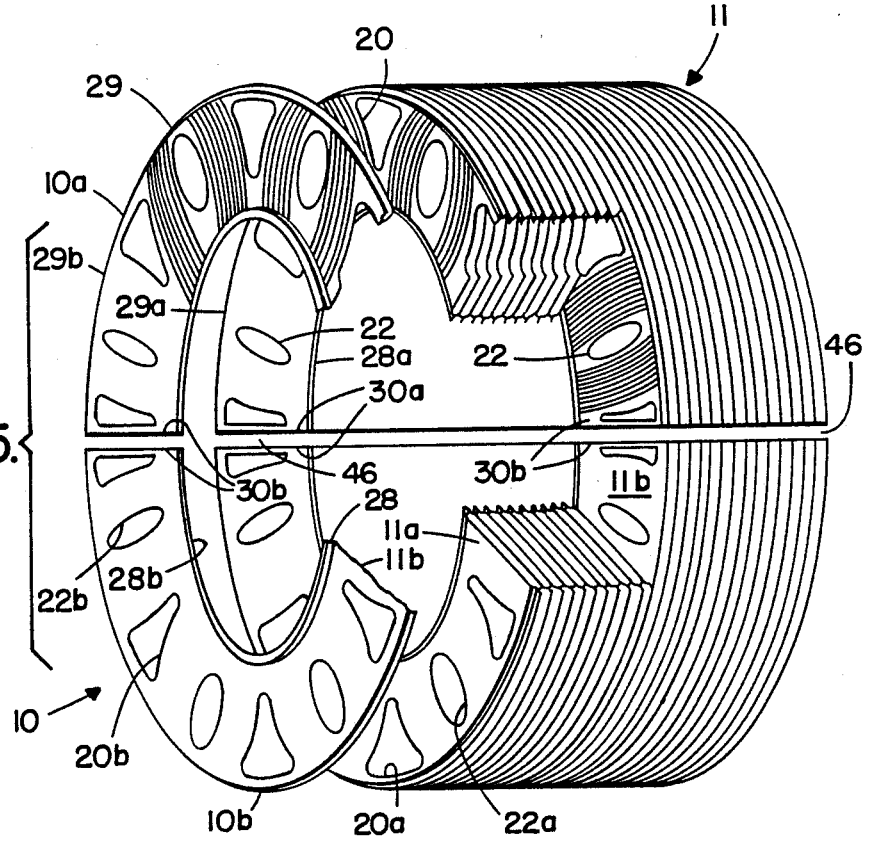
FIG. 5 is a perspective view, partially cut away and spaced for illustrative purposes, of a portion of a segmented heat exchange bellows unit or recuperator comprising hemi-cylinders of assembled plate pairs, the plates having been welded in conventional manner to form a cylindrical unit which is then cut longitudinally or axially in predetermined aligned areas to form hemi-cylinders.
Figure 8:
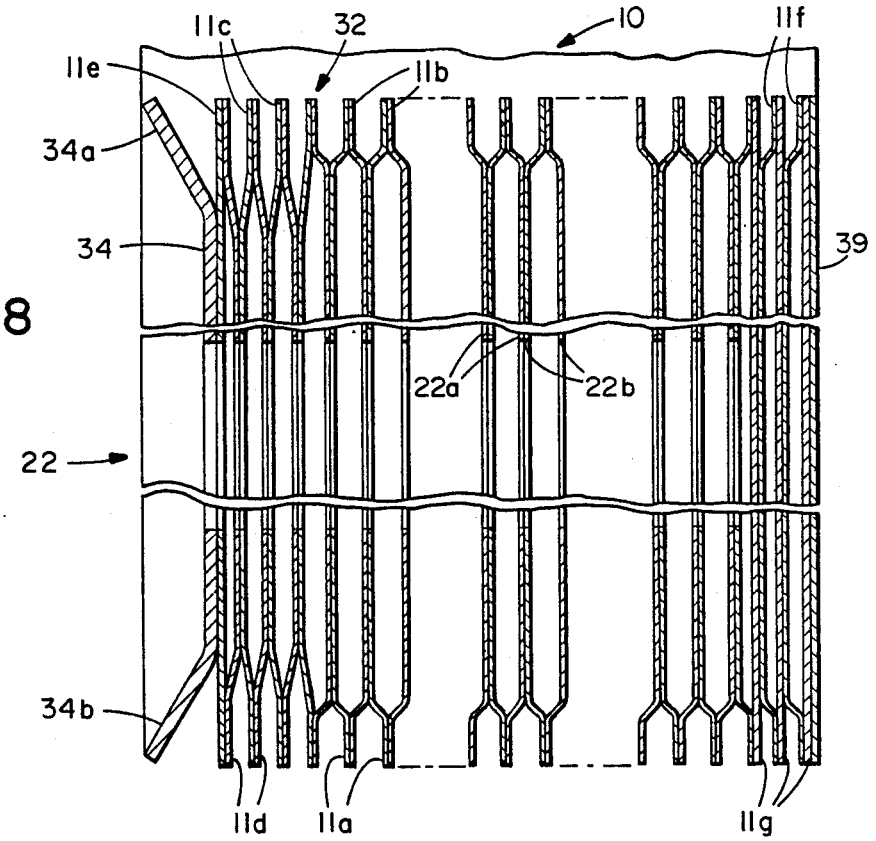
FIG. 8 is a segmented longitudinal cross-sectional view of a heat-exchange bellows unit hemi-cylinder according to the present invention, illustrating the configuration of the forward and aft plates and the plate pairs.

The bellows unit 10 or stack of plates 11, FIG. 5, comprises a series of plate pairs formed from alternately arranged plates **11*a* and 11*b*, which are identical in outline and differ primarily in the flow path-defining corrugations formed therein. The plates 11*a* and 11*b* are in the form of annular discs having inner and outer peripheral flanges 28 and 29. The flanges of the plates 11*a* project in on axial direction and the flanges of the plates 11*b* project in the opposite axial direction (FIG. 8). Successive pairs of plates 11*a* and 11*b* are thus disposed with their flanges 28 and 29 in face-to-face relation. These matching flanges are seam welded or otherwise joined around their full circumferences. The pairs of plates, thus joined, define the radial bounds of the cross flow paths between plenums 20 and 22** within the heat exchanger compartment of each plate pair.

The plenums 20 and 22 comprise aligned flange openings 20*a*, 20*b* and 22*a*, 22*b*, formed in the plates 11*a* and 11*b* respectively. The surfaces of plates 11*a* and 11*b* of each pair facing outwardly of the peripheral flange welds 28*a* and 29*a* are oppositely flanged and are joined to adjacent plate pairs, as by welding, peripherally of the openings 22*a*, 22*b* and 20*a*, 20*b*, FIGS. 5 and 8. The stack of plates 11 is thus joined in fashion to form the bellows unit 10.

Figure 6:
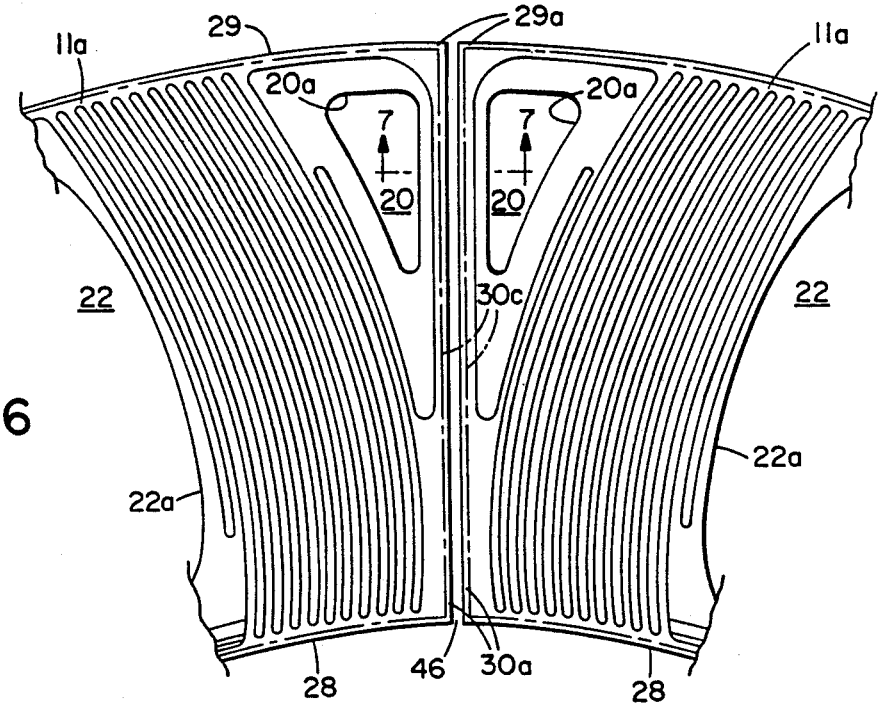
FIG. 6 is a radial cross sectional view of a portion of the segmented heat-exchange bellows unit of FIG. 5, illustrating the configuration of one of the plate pairs thereof in the area of the opposed radial cuts which segment the unit into two hemi-cylindrical segments.

Referencing next FIGS. 5 and 6, it will be noted that the openings 22*a* and 22*b* are generally elliptical and that the openings 20*a* and 20*b* are generally triangular and that the adjacent sides of each opening 20 and 22 are similarly curved, or generally concentric. This relationship, maximizes the heat transfer area of the plates and minimizes the overall volume, or space envelope, of the heat exchanger, when coupled with correspondingly curved corrugations in the plates 11*a* and 11*b*.

More specifically, as disclosed in detail in U.S. Pat. No. 3,831,674 each of the plates 11*a* has a series of corrugations between adjacent openings 20*a* and 22*a*. The corrugations are generally sinusoidial or what will herein be referenced as "regular wave-form". The wave form corrugations extend, generally radially, from the inner flange 28 to the outer flange 29 and are further curved, to correspond to the curvature of the sides of the openings 20*a* and 22*a* between which they extend. Each plate 11*b* is corrugated in a more involved fashion. First, there are flow path defining corrugations which extend marginally of the openings 22*b* and 20*b* respectively. The corrugations are curved similarly to the wave-form corrugations and are "out of phase" therewith so as to sealingly engage matching corrugations respectively adjacent the openings 22*a* and 20*a*. The corrugations, on opposite sides of the exit plenum opening 22*b*, extend inwardly from the outer flange 29*b* and terminate at a point space outwardly of the inner flange 28*b*. In a similar fashion, the corrugations, on opposite sides of each inlet plenum 20*a*, extend outwardly from the inner flange 28*b* and terminate in spaced relationship from the outer flange 29*a*. Between the corrugations, is a series of corrugations of an intermediate height, which have a similar curvature to the curvature of the wave form corrugations, are of the same spacing and also "out of phase" therewith. It will also be seen that the series of wave form corrugations extend from the inner flange 28*b* to the outer flange 29*b*. Further, there is a series of cross corrugations generally at right angles to the wave form corrugations, generally concentric of the axis of the plates 11 and having a spacing generally matching that of the wave form corrugations. The height of the cross corrugations matches that of the other corrugations, so that there is a grid of engagement points between the corrugations within the boundary defined by the co-extensive portions of the corrugations, herein referenced as a zone of primary heat transfer. In the areas above and below, are inlet and exit chambers, which have a "waffle" type surface formed by the intermediate wave form corrugations and cross corrugations which are of the same intermediate height.

The described configuration of the plates 11*a* and 11*b* defines cross flow paths within the heat exchange compartments of plate pairs from one inlet plenum 20 to the adjacent exit plenums 22 on either side thereof. The outer grid work of the intermediate height corrugations form a lateral entrance chamber. From this lateral entrance chamber, the cross flow path extends radially inwardly between the co-extensive portions of the corrugations forming a zone of primary heat transfer, and then through a discharge chamber similar to the entry chamber described above except that the opening thereof directs the air towards the plenum 22.

It will be noted that the cross flow path described, provides throughout its length, a varying cross sectional area and longitudinal sectional area which minimizes the boundary layers and thus increases the rate of heat transfer. Further, it will be noted that in the grid of corrugations in the primary heat transfer zone, between the co-extensive areas of corrugations, the variations in the flow path area become more pronounced for greater heat transfer effectiveness. This is opposed to the entry and exit chambers which, while providing flow area variation, also facilitate lateral flow of the air to facilitate its entry and discharge from the primary area.

Using FIG. 5 as a point of reference, the corrugations to the right of the opening 20*b* between the next adjacent opening 22 would define the same series of an entry chamber, primary exchange zone and discharge chamber as described above. In both instances, the air, from the inlet plenum 20, enters the outer corner of the grid work and flows radially inwardly. This is to say that air passing through the plenum 20 has a split cross flow path to both of the adjacent plenums 22 and similarly both of the plenums 22 receives cross flow from the plenums 20 on either side thereof, as is also indicated in FIG. 5.

It will also be noted that in each instance, the secondary flow of the internal pressurized air from the passageways 20 to the passageways 22 is counter to the flow of the external hot gas stream in the primary area of heat exchange.

All of these factors contribute to a high rate of heat exchange for greater efficiency. Further, the described configuration of both the cross flow paths of the pressurized air and the flow paths of the hot gas discharge have proven to be highly effective in minimizing pressure drops so as to minimize the decrease in overall cycle efficiency which is attributable to such loses.

The described corrugations of the plates 11*a* and 11*b* contribute to the overall efficiency of the heat exchanger in that the spring effect, or resilience, of these corrugated plates minimizes induced stresses in the plates which are inherent in any operation in a high temperature environment as described. Thus, in a cyclic operation of the engine heat exchanger, the plates 11*a* and 11*b* will contract and expand exerting compressive forces on the plates themselves which vary in magnitude during operational cycles. The resultant low stresses achieved enable, for a given plate material, use of thinner section material which further contributes to the efficiency of heat transfer. The ability to utilize thinner section material for the plates 11*a* and 11*b* also minimizes the overall weight of the heat exchanger, to the end that it's incorporation in a gas turbine engine used for the propulsion of aircraft becomes more efficient in that the overall aircraft system.

Figure 7:
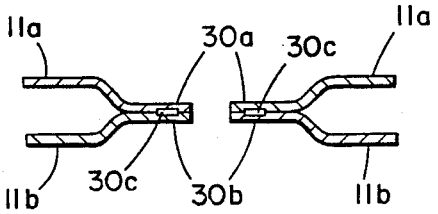
FIG. 7 is a view taken along the line 7—7 of FIG. 6.

In oder to increase the resistance of such thin plate heat exchange units to cracking and excessive pressure drops resulting therefrom, over prolonged periods of time, the present units are formed from annular plates 11 having at least two opposed planar radial flange areas 30, the radial flanges 30*a* of each plate 11*a* projecting in one axial direction and the radial flanges 30*b* of each plate 11*b* projecting in the opposite axial direction so that flanges 30*a* and 30*b* are in face-to-face contact when plates 11*a* and 11*b* are peripherally welded to each other, as illustrated by FIGS. 5 to 7. This provides a unitary cylindrical heat exchanger unit, similar to those of U.S. Pat. Nos. 3,785,435 and 3,831,674, with the critical difference that each pair of plates 11*a* and 11*b* has at least two opposed radial contact areas 30 through which the unit can be cut in the axial direction to provide at least two axial segments, such as hemi-cylinders 10*a* and 10*b*, shown most clearly in FIG. 5. After the cutting operation, the cut edges of each plate pair 11*a* and 11*b*, comprising the contacting radial flanges 30*a* and 30*b* are welded to each other by means of continuous radial welds 30*c* which extend through the outer peripheral weld 29*a* and through the inner peripheral weld 28*a* which unite the plates 11*a* and 11*b* at flanges 28 and 29. This seals the heat exchange compartments between the plate pairs of each segment against any leakage. Thus each heat exchanger segment 10*a* and 10*b* provides the same sealed intercommunication between the plenums 20 and 22 thereof as is possessed by the unit 10 prior to the segmenting thereof.

It will be apparent that the radial flange areas 30 need not be located in areas which bisect pairs of inlet plenum openings 20*a* and 20*b*, as shown by the illustrated embodiment. The flange areas 30 may bisect the combustor air plenum openings 22*a* and 22*b*, or may be located on radial plate areas between the plenum openings, the only requirement being that each plate 11 has at least two opposed radial flange areas which extend from the outer peripheral flange 29 to the inner peripheral flange 28, the flange areas on all plates being identically located, such as diametrically-opposite each other, and that the radial welds 30*c* are applied to extend through the inner and outer peripheral welds 28*a* and 29*a*.

As illustrated by FIG. 8, the heat exchanger bellows unit 10 includes, in addition to the plates 11*a* and 11*b*, a forward thermal damper plate assembly 32 comprising three compressible plate pairs 11*c* and 11*d*, a somewhat thicker thermal damper plate 11*e* and a thicker forward mounting plate 34 which is dish-shaped to provide inner and outer peripheral flanges 34*a* and 34*b* which form seats for sealing engagement with correspondingly-shaped annular seats 14*a* and 14*b* on the housing 14, as shown by FIG. 1. It will be understood that the plates of the thermal damper assembly 32 are similar in appearance and interconnection to the plates 11*a* and 11*b* discussed hereinbefore, i.e., each plate is provided with the flanged openings 20 and 22 and radial flanges, similar to 30*a* and 30*b*, which enable the cylindrical unit 10 to be cut into segments and radially-welded to form the sealed segments or hemicylinders 10*a* and 10*b*.

The aft end of the heat-exchanger 10 also comprises full annular damper plates 11*f* and 11*g* which are blind, i.e., devoid of the axial plenums 20 and 22 so that the compressed inlet air and the outlet air to the combustor cannot pass thereby. The final downstream plenum plate 11*a* is peripherally welded to the adjacent blind plate 11*g* to close the heat-transfer compartment and unite the segments 10*a* and 10*b* to each other at the aft end. The two final downstream plate pairs 11*f* and 11*g* are full blind annular plates which are not peripherally welded to each other but are merely assembled therewith within the frame portion 24.

Figure 10:
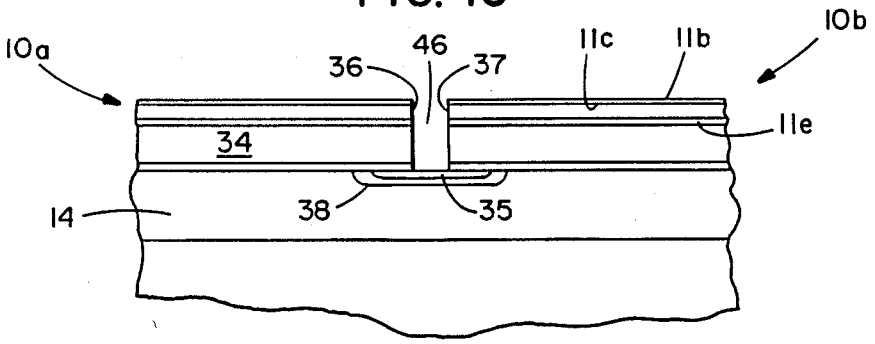
FIG. 10 is a view taken along the line 10—10 of FIG. 9 and further illustrating the coupling strap received within the recessed groove or channel of a cap member.
Figure 9:
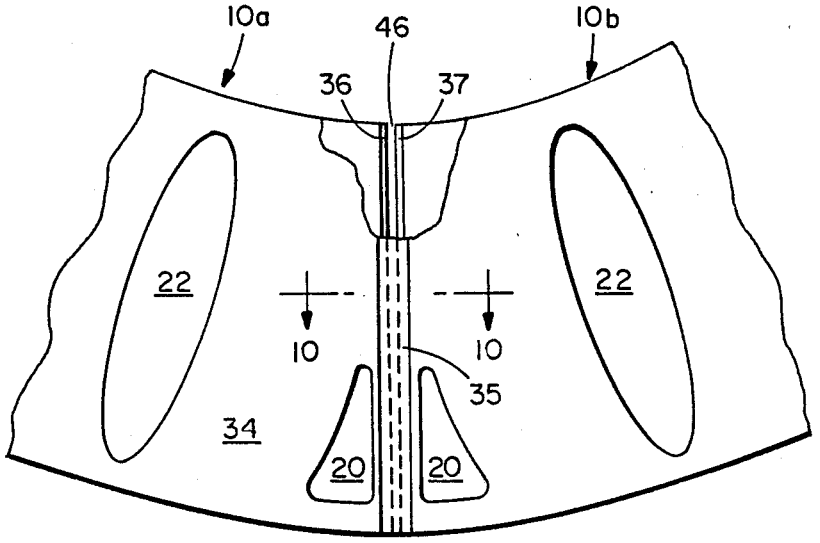
FIG. 9 is a front view of lower segments of the front plates of a companion pair of hemi-cylinders, of the type illustrated by FIG. 8, united by means of a lower coupling strap.

Referring to FIGS. 9 and 10, the hemicylinders 10*a* and 10*b* are connected to each other at the forward end to form a cylinder assembly by welding narrow coupler strap segments 35 adjacent the opposed radial edges 36 and 37 at the top and bottom of the forward annular mounting plate 34, a cross-section of the bottom strap segment 35 being illustrated by FIG. 9, seated within a radial recess 38 provided within the forward adaptor frame 14. As also shown in FIG. 10, the edges 36 and 37 of the segments 10*a* and 10*b* are slightly spaced to provide room for expansion of the segments during use.

Figure 3:
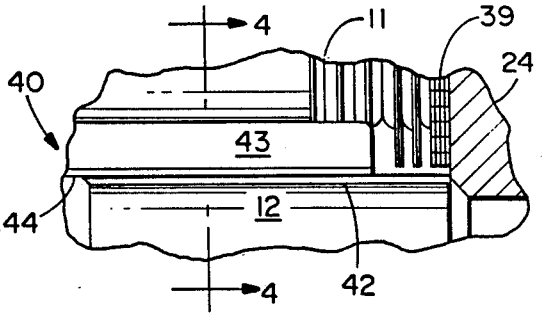
FIG. 3 is an exploded view of another segment of FIG. 1 illustrating the aft interior peripheral seal between the plate unit and the housing, and also illustrating the aft end of the upper longitudinal gas seal insert strip supported at the aft end of the assembly by an inner peripheral aft band, as an aft upper inner gas seal between the recuperator and the housing.
Figure 4:
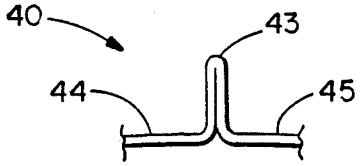
FIG. 4 is a cross section of a gas seal insert strip, taken along the line 4—4 of FIG. 3.

The segments 10*a* and 10*b* are united at the aft end by welding the final downstream plenum plate 11*a* to the adjacent full annular blind plate 11*g* as discussed hereinbefore and as shown in FIGS. 3 and 8.

While the reassembled heat exchanger unit 10 has the plenums 20 and 22 of each segment 10*a* and 10*b* sealingly interconnected to each other, it will be apparent that the axial inner peripheral spaces between the segments, within the center passage 12 would normally provide free escape routes for the hot gas discharge from the central passage 12 to the exhaust duct. This is avoided in the present assembly by the provision of axial inner peripheral seal members 40, and forward and aft ring supports 41 and 42, as shown in FIGS. 1 to 4. Thus, an axial seal member 40, such as a metal strip bent to provide an alignment flange 43 and adjacent opposed surface flanges 44 and 45, is inserted within each of the axial slots 46 along the inner periphery of the heat-exchanger unit 10, i.e., the axial spaces formed by segmenting unit 10 into sections 10*a* and 10*b*.

The alignment flange 43 extends into a slot 46 and the surface flanges 44 and 45 extend outwardly therefrom over the inner periphery of the segments 10*a* and 10*b* a short distance adjacent said slot 46 to block the entry of discharge gas from the compartment 12 into each of the slots 46, thereby forcing the hot gas to pass between the heat exchanger plates.

The axial seal members 40 are held in place by the extension of the ends thereof beneath the forward and aft ring supports 41 and 42 which are welded to the housing 14 and extend out over the leading and trailing ends of the inner periphery of the heat exchanger unit 10, including the thermal damper section 32 and the blindplates 11*f* and 11*g*. The forward ring support 41 is also welded to the inner periphery of the coupling plate 34.

It is to be understood that the above described embodiments of the invention are illustrative only and that modifications throughout may occur to those skilled in the art. Accordingly, this invention is not to be regarded as limited to the embodiments disclosed herein, but is to be limited as defined by the appended claims.

What is claimed is:

1. In a longitudinal annular plate heat exchanger unit for recuperating heat from an engine discharge gas for recirculation back to a combustor, said unit comprising a plurality of pairs of annular plates, each plate having correspondingly-located inlet openings and exit openings forming axial gas inlet passages and axial gas outlet passages through the unit, the plates of each plate pair being joined to each other about their inner and outer peripheries by means of inner and outer peripheral welds to form a heat exchange compartment within each plate pair, each plate pair being welded to an adjacent plate pair about their gas inlet and gas outlet openings to form a sealed intercommunication between the heat exchange compartmets of all of the plate pairs, whereby a fluid, such as air, can be forced through the axial inlet passages of the unit, heated by the transfer of heat from an external hot gas discharge passing radially through the unit, externally of the plate pairs, and returned in heated condition through the axial outlet passages to a combustor, the improvement which comprises the use of annular plates to provide plate pairs having at least two opposed radial areas in which the plates of each pair make continuous line contact between their inner and outer peripheries, each of the plate pairs being segmented along said radial areas and the plates of each pair being united by means of radial welds which extend through the inner and outer peripheral welds, to provide at least two companion longitudinal heat exchanger segments designed to be assembled as a unit having axial heat-expansion spaces therebetween.

2. A heat exchanger unit according to claim 1 in which said companion heat exchanger segments are united as a cylindrical unit in which the plate pairs of each segment are spaced from the plate pairs of adjacent segments by said axial heat expansion spaces, annular plates at the forward and aft ends of said segments being united to form a cylindrical unit and said axial spaces extending therebetween.

3. A heat exchanger unit according to claim 2 further comprising a plurality of narrow elongate gas seal members attached to the inner periphery of said cylindrical unit, one covering the inner peripheral opening of each of said axial spaces to block the radial flow of discharge gas into said spaces.

4. A heat exchanger unit according to claim 3 further comprising a pair of inner peripheral circular gas seal ring members, one attached over the inner periphery of the cylindrical unit at the forward end thereof and the other attached over the inner periphery of the cylindrical unit at the aft end thereof, the forward and aft ends of each of said narrow elongate gas seal members being confined between said forward and aft ring members and the inner periphery of the annular plates said cylindrical unit.

5. A recuperator for receiving compressed fluid such as air and hot discharge gas in isolated relation to each other and for transferring heat from the discharge gas to the compressed air and for returning the heated compressed air to a combustor, comprising a housing containing assembled heat exchanger segments as defined in claim 1, said housing comprising a plurality of peripheral compressed gas inlet openings communicating with the axial gas inlet passages of said heat exchanger segments and a plurality of peripheral gas outlet openings communicating with the axial gas outlet passages of said heat exchanger segments, a central hot gas discharge opening to a central axial passage for receiving hot discharge gas at the inner periphery of said annular heat exchanger segments, and a discharge gas exhaust at the outer periphery of said annular heat exchanger segments to receive and exhaust the discharge gas after it has flowed radially through the heat-exchanger segments, between the plate pairs thereof, to transfer heat to the compressed gas isolated within the heat-exchanger segments, said heat exchanger segments being spaced from each other by at least two axial slots, and a narrow elongate gas seal member covering the inner peripheral opening of each said axial slot to block the radial flow of discharge gas from the central axial passage of said housing through the radial slots between said heat exchanger segments.

* * * * *